US008862048B2

(12) United States Patent
Devine et al.

(10) Patent No.: US 8,862,048 B2
(45) Date of Patent: Oct. 14, 2014

(54) EQUIPMENT, SYSTEM AND METHODOLOGIES FOR SEGMENTATION OF LISTENING AREA INTO SUB-AREAS ENABLING DELIVERY OF LOCALIZED AUXILIARY INFORMATION

(75) Inventors: Christopher F. Devine, Winnetka, IL (US); Richard J. Bonick, Evanston, IL (US); William R. Hieatt, Colleyville, TX (US)

(73) Assignee: Geo-Broadcast Solutions, LLC, Chicago, IL (US)

( * ) Notice: Subject to any disclaimer, the term of this patent is extended or adjusted under 35 U.S.C. 154(b) by 932 days.

(21) Appl. No.: 12/879,081

(22) Filed: Sep. 10, 2010

(65) Prior Publication Data

US 2011/0065377 A1 Mar. 17, 2011

Related U.S. Application Data

(60) Provisional application No. 61/241,790, filed on Sep. 11, 2009, provisional application No. 61/368,509, filed on Jul. 28, 2010.

(51) Int. Cl.

| | |
|---|---|
| ***H04H 20/71*** | (2008.01) |
| ***H04H 20/26*** | (2008.01) |
| ***H04H 20/10*** | (2008.01) |
| ***H04H 60/13*** | (2008.01) |
| ***H04H 20/67*** | (2008.01) |

(52) U.S. Cl.

CPC ..... *H04H 20/67* (2013.01); *H04H 20/26* (2013.01); *H04H 20/103* (2013.01); *H04H 60/13* (2013.01)

USPC ..... 455/3.01; 455/522; 455/63.1; 455/501; 455/502; 455/503

(58) Field of Classification Search

CPC ..... H04H 20/26; H04H 20/67; H04H 20/103; H04H 20/22; H04H 60/13; H04W 4/06; H04W 56/00; H04W 72/005; H04W 84/022

See application file for complete search history.

(56) References Cited

U.S. PATENT DOCUMENTS

| | | | |
|---|---|---|---|
| 3,639,686 | A | 2/1972 | Walker et al. |
| 4,720,873 | A | 1/1988 | Goodman et al. |

(Continued)

FOREIGN PATENT DOCUMENTS

| | | |
|---|---|---|
| EP | 0 443 933 | 8/1991 |
| EP | 1 526 666 | 4/2005 |

(Continued)

OTHER PUBLICATIONS

International Search Report for International Application No. PCT/US2010/048331, dated Sep. 10, 2010.

(Continued)

*Primary Examiner* — Zhiyu Lu
*Assistant Examiner* — Fanghwa Wang
(74) *Attorney, Agent, or Firm* — Barnes & Thornburg LLP

(57) ABSTRACT

Radio broadcasting equipment is provided that enables targeted radio broadcast advertisement delivery in an radio broadcast area wherein a plurality of radio transmitters are used to transmit broadcasting area wide programming and localized auxiliary information on a single frequency and wherein broadcasting area wide programming is transmitted by at least one of the radio transmitters and localized auxiliary information is transmitted by individual radio transmitters included in the plurality of transmitters.

25 Claims, 9 Drawing Sheets

(56) References Cited

U.S. PATENT DOCUMENTS

| | | | | |
|---|---|---|---|---|
| 4,864,564 | A | 9/1989 | Parker et al. | |
| 5,117,503 | A * | 5/1992 | Olson | 455/502 |
| 5,155,591 | A | 10/1992 | Wachob | |
| 5,471,642 | A | 11/1995 | Palmer | |
| 5,515,098 | A | 5/1996 | Carles | |
| 5,652,615 | A | 7/1997 | Bryant et al. | |
| 5,664,948 | A | 9/1997 | Dimitriadis et al. | |
| 5,708,478 | A | 1/1998 | Tognazzini | |
| 5,805,989 | A | 9/1998 | Ushida | |
| 5,974,034 | A * | 10/1999 | Chin et al. | 370/328 |
| 6,011,977 | A | 1/2000 | Brown et al. | |
| 6,029,045 | A | 2/2000 | Picco et al. | |
| 6,088,349 | A | 7/2000 | Zumkeller | |
| 6,163,683 | A * | 12/2000 | Dunn et al. | 455/151.1 |
| 6,349,215 | B1 | 2/2002 | Braun | |
| 6,463,454 | B1 | 10/2002 | Lumelsky et al. | |
| 6,519,262 | B1 * | 2/2003 | Stephens et al. | 370/442 |
| 6,577,849 | B1 | 6/2003 | Eaton et al. | |
| 6,600,908 | B1 | 7/2003 | Chan | |
| 6,615,039 | B1 | 9/2003 | Eldering | |
| 6,671,880 | B2 | 12/2003 | Shah-Nazaroff et al. | |
| 7,038,589 | B2 | 5/2006 | Schmidt et al. | |
| 7,062,778 | B1 | 6/2006 | Pattersson | |
| 7,313,359 | B2 | 12/2007 | Steelberg et al. | |
| 7,313,361 | B2 | 12/2007 | Steelberg et al. | |
| 7,315,726 | B2 | 1/2008 | Steelberg et al. | |
| 7,363,001 | B2 | 4/2008 | Steelberg et al. | |
| 7,376,414 | B2 | 5/2008 | Engstrom | |
| 7,460,863 | B2 | 12/2008 | Steelberg et al. | |
| 7,490,053 | B1 | 2/2009 | Emerson, III et al. | |
| 7,500,258 | B1 | 3/2009 | Eldering | |
| 7,551,888 | B2 | 6/2009 | Kopra et al. | |
| 7,826,444 | B2 | 11/2010 | Irvin | |
| 2002/0141491 | A1 | 10/2002 | Corts et al. | |
| 2002/0184091 | A1 | 12/2002 | Pudar | |
| 2003/0018971 | A1 | 1/2003 | McKenna, Jr. | |
| 2006/0019642 | A1 | 1/2006 | Steelberg et al. | |
| 2006/0117350 | A1 | 6/2006 | Stallworth | |
| 2006/0212409 | A1 | 9/2006 | Steelberg et al. | |
| 2007/0146200 | A1 | 6/2007 | Norin et al. | |
| 2007/0226608 | A1 | 9/2007 | Virk et al. | |
| 2007/0232326 | A1 | 10/2007 | Johnson | |
| 2008/0008285 | A1 | 1/2008 | Smith et al. | |
| 2008/0048873 | A1 | 2/2008 | Araiza-Boys | |
| 2008/0092162 | A1 | 4/2008 | Lundy et al. | |
| 2008/0127250 | A1 | 5/2008 | DaCosta | |
| 2008/0160940 | A1 | 7/2008 | Jendbro | |
| 2008/0187009 | A1 | 8/2008 | Kim et al. | |
| 2008/0209466 | A1 | 8/2008 | Ishida et al. | |
| 2008/0313169 | A1 | 12/2008 | Walzien | |
| 2009/0029672 | A1 | 1/2009 | Manz | |
| 2009/0045951 | A1 | 2/2009 | Rajan et al. | |
| 2009/0046616 | A1 | 2/2009 | Martinez et al. | |
| 2009/0046624 | A1 | 2/2009 | Martinez et al. | |
| 2009/0094648 | A1 | 4/2009 | Patel et al. | |
| 2009/0122749 | A1 | 5/2009 | Byun | |
| 2009/0172724 | A1 | 7/2009 | Ergen et al. | |

FOREIGN PATENT DOCUMENTS

| | | |
|---|---|---|
| EP | 1 816 764 | 8/2007 |
| GB | 2 195 868 | 4/1988 |
| JP | 59-54342 | 4/1984 |
| WO | 93/00774 | 1/1993 |
| WO | 2006/035242 | 4/2006 |

OTHER PUBLICATIONS

Written Opinion of the International Searching Authority for International Patent Application No. PCT/US2010/048331, dated mailed Sep. 10, 2010.

"Harris Has Third Generation of SynchroCast", www.rwonlin.com/printarticle.aspx, 15949, Radio World, The News Source for Radio Managers and Engineers.

"Simmons Uses Harris SynchroCast in Salt Lake", www.radioworld.com/printarticle.aspx, 13732, Radio World, The News Source for Radio Managers and Engineers.

"Harris to Showcase Intraplex SynchroCast Platform Improvements", www.radioworld.com/printarticle.com, 16545, Radio World, The News Source for Radio Managers and Engineers.

"Harris Has SynchroCast 3 for Multi-Transmitter Networks", www.radioworld.com/printarticle.aspx, 15980, Radio World, The News Source for Radio Managers and Engineers.

"Harris Corporation's Intraplex SynchroCast Digital Multiplexer Extends Reach of Popular News, Talk and Music Channels Throughout the Greek Isles", www.harris.com/view_pressrelease.asp, 1738.

"Harris Corporation's Intraplex SynchroCast Digital Multiplexer Enhances Radio Coverage for Simmons Media in Salt Lake City", www.harris.com/view_pressrelease.asp, 1792.

Harris Synchrocast 3 Enables Single-Frequency Networks Over IP Links, Radio Magazine, www.printthis.clickability.com/pt/cpt, Radio Magazine.

Supplementary European Search Report for Application No. 10816113.4 dated Jul. 17, 2013.

* cited by examiner

EQUIPMENT, SYSTEM AND METHODOLOGIES FOR SEGMENTATION OF LISTENING AREA INTO SUB-AREAS ENABLING DELIVERY OF LOCALIZED AUXILIARY INFORMATION

CROSS-REFERENCE TO RELATED APPLICATIONS

This U.S. Non-Provisional patent application relies for priority on U.S. Provisional Patent Application Ser. No. 61/241,790, filed on Sep. 11, 2009, entitled "Equipment, System And Methodologies For Segmentation Of Listening Area Into Sub-Areas Enabling Delivery Of Localized Auxiliary Information," and U.S. Provisional Patent Application Ser. No. 61/368,509, filed Jul. 28, 2010 and entitled "Equipment, System And Methodologies For Segmentation Of Listening Area Into Sub-Areas Enabling Delivery Of Localized Auxiliary Information," both of which being incorporated by reference in their entireties.

FIELD OF THE INVENTION

Disclosed embodiments are directed, generally, to radio broadcasting equipment, as system and methodologies that enable targeted radio broadcast delivery in a radio broadcast area.

BACKGROUND

Radio broadcasters obtain revenue by selling advertising commercial time, wherein the commercials, or "spots" are incorporated into the content broadcast by the radio broadcaster in broadcasting listening area. Typically, such broadcasters' listening areas are associated with a metropolitan area or geographic region and commercial time is sold to advertisers within that area or region.

However, the value of such commercial time is, in part, based on the number of listeners that are potentially hearing a commercial; nevertheless, the effectiveness of those commercials in persuading a listener to partake of an advertised product or service or visit an advertiser's location may be based, at least in part, on the availability of the advertiser's product, service or location to a listener. Thus, although a radio station listener may hear an advertiser's commercial, the likelihood that the listener may purchase the advertiser's product/service or visit the advertiser's location is at least in part based on the availability of advertiser's product/service or proximity of the advertiser's location.

SUMMARY

The following presents a simplified summary in order to provide a basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to the more detailed description below.

In accordance with at least one disclosed embodiment, radio broadcasting equipment is provided that enables targeted radio broadcast advertisement delivery in an radio broadcast area wherein a plurality of radio transmitters are used to transmit broadcasting area wide programming and localized auxiliary information on a single frequency and wherein broadcasting area wide programming is transmitted by at least one of the radio transmitters and localized auxiliary information is transmitted by individual radio transmitters included in the plurality of transmitters.

BRIEF DESCRIPTION OF THE DRAWINGS

A more compete understanding of the present invention and the utility thereof may be acquired by referring to the following description in consideration of the accompanying drawings, in which like reference numbers indicate like features, and wherein.

DETAILED DESCRIPTION

Figure 1:
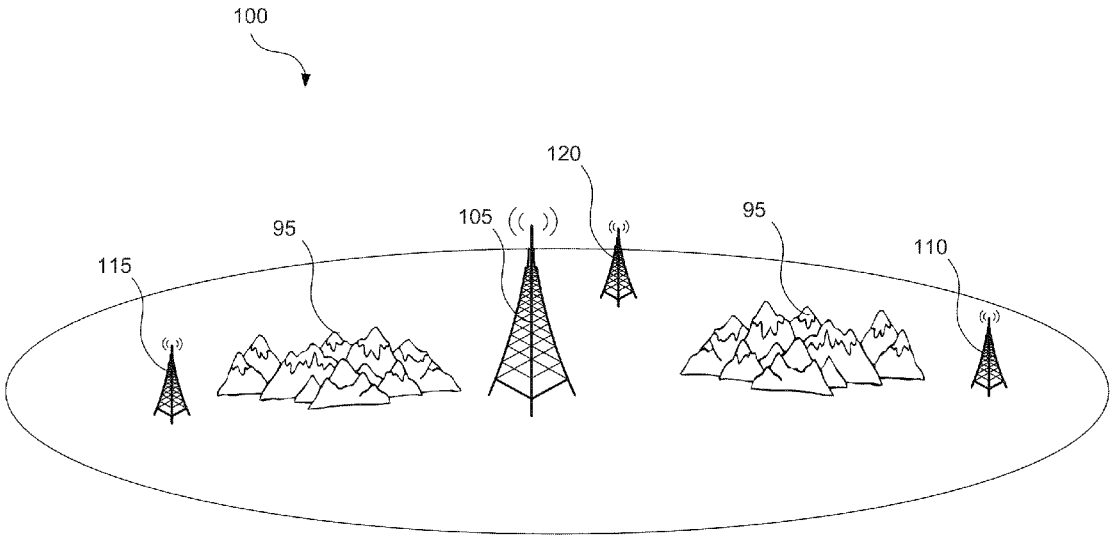
Figure 1 Prior Art
FIG. 1 illustrates one example of a conventionally known radio broadcast listening area in which simulcasting technology may be used to provide effective broadcasting from a plurality of antennas on a single frequency.

The description of specific embodiments is not intended to be limiting of the present invention. To the contrary, those skilled in the art should appreciate that there are numerous variations and equivalents that may be employed without departing from the scope of the present invention. Those equivalents and variations are intended to be encompassed by the present invention.

In the following description of various embodiments, reference is made to the accompanying drawings, which form a part hereof, and in which is shown, by way of illustration, various embodiments in which the invention may be practiced. It is to be understood that other embodiments may be utilized and structural and functional modifications may be made without departing from the scope and spirit of the present invention.

It should be understood that the term "radio broadcaster" is meant to include organizations and/or individuals involved in the broadcast of audio radio broadcasting area wide programming and localized auxiliary information. The term "broadcasting area wide programming" or "license coverage area" is meant to include, for example, programming content that is intended to be distributed throughout a particular broadcasting area; thus, depending on the format of the station, such programming may include, for example, talk radio programs, music programs, songs, etc. Likewise, the term "localized auxiliary information" is meant to include, e.g., advertisements, public safety information, public service information, emergency broadcast information, etc. Thus, radio broadcasters are not limited to individuals or organizations owning licenses for radio broadcasting; however, the term radio broadcaster does include such individuals or organizations.

In explaining the operation of various disclosed embodiments, description of one or more "main transmitters" and "booster transmitters" is provided. It should be understood that the term "main transmitter" encompasses a transmitter that may be, for example, the only transmitter used by a radio broadcaster in a particular radio broadcasting area or it may be the most powerful (or one of the most powerful) transmitters in the radio broadcasting area.

To the contrary, the term "booster transmitter" (which is interchangeable with the term "signal boosters") includes low-power transmitters (relative to the maximum class of the main transmitter), which are conventionally used to improve communications in locations within the normal coverage area of a radio system where the radio signal is blocked or shielded due to natural terrain or man-made obstacles (e.g., to provide fill-in coverage but not increase the normal coverage area).

Booster transmitters can be effective in weak or no-signal areas that may be present in a radio broadcaster's area of operation; however, booster transmitters are designed so as not to extend the broadcast signal beyond a radio broadcaster's licensed broadcast area. Such booster transmitters can be used to compensate or accommodate for physical barriers to effective radio broadcast transmission, e.g., mountains, mountain ranges, steep valleys, large buildings, vegetation, etc.

As illustrated in FIG. 1, a radio broadcaster's listening area 100 can include various physical barriers to effective radio broadcast transmission such as mountain ranges 95. Accordingly, a main transmitter 105 for the listening area 100 can be augmented by booster transmitters 110-120 that can be conventionally configured to provide the radio broadcaster's signal to areas of the listening area 100 blocked from receiving the broadcast signal from the main transmitter 100.

The presence of such physical barriers has been addressed by the addition of either booster transmitters on the same frequency or translator transmitters on a different frequency. However, translator transmitters can only be used subject to the availability of usable frequencies in a particular radio broadcasting market and require additional Federal Communications Commission (FCC) licensing. Thus, boosters have particular utility when increasing a station's signal strength because broadcast frequencies of a primary signal (associated with a main transmitter) and secondary signals are identical, whereas, in a translator-implemented system they are different. Moreover, there are significant FCC restrictions limiting translator power and limiting advertising revenue; further, automobile radios, fixed receivers, cell phones with FM tuners, etc. must be re-tuned to a translator's frequency when the automobile moves out of the area for the main transmitter.

The FCC allows the use of booster transmitters on various paging frequencies at 931-932 MHz and the VHF one-way public paging channels, on various private land mobile and paging frequencies above 150 MHz, and on various Multiple Address System (MAS) frequencies at 928-960 MHz. The FCC allows licensees to use booster signals to provide fill-in signal coverage without a separate FCC license authorization. Accordingly, booster transmitters are conventionally used by FCC licensees to improve radio system efficiency at less cost and without imposing an additional licensing burden on either the licensee or the FCC.

Under FCC guidelines, the maximum permissible booster power is generally 20 percent of a licensee's class maximum, with exceptions in the geographic areas near Mexico and Canada. Thus, typically available booster transmitters have a transmission power output that is adjustable between 5 and 3,000+Watts. Under FCC guidelines, a radio broadcaster may be permitted to deliver its broadcast signal within its licensed broadcasting area by whatever means is technically suitable. Therefore, conventionally, programming and auxiliary information to be broadcast are transmitted to the main transmitter and booster transmitters using multiplexed digital Studio-Transmitter Links (STLs), across leased T1/E1 circuits, microwave radio links, Inter City Relay, telephone lines, dedicated cables, fiber optics, etc.

Figure 2:
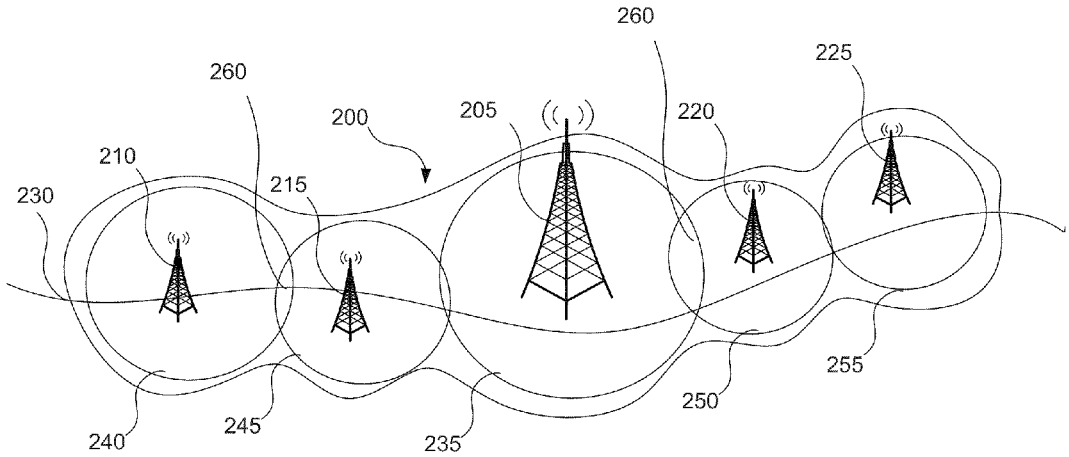
Figure 2 Prior Art
FIG. 2 illustrates another example of a conventionally known radio broadcast listening area in which simulcasting technology may be used to provide effective broadcasting from a plurality of antennas on a single frequency.

Additionally, linearly placed simulcast booster transmitters can be utilized to provide coverage over a more selective area, for example, a longer narrow market, e.g., associated with a highway or population corridor or the like. For example, as illustrated in FIG. 2, a radio broadcaster's listening area 200 may be configured to track a highway 230 or other population corridor (e.g., within a long valley). However, because of the physical characteristics of propagating broadcast waves, it is often difficult to implement with a single main transmitter with an appropriately selected transmission power. Therefore, booster transmitters can be used to configure an elongated listening area 200 that is comprised of what is called the "capture areas" for the main transmitter and a plurality of booster transmitters. More specifically, with reference to FIG. 2, the listening area 200 includes the capture area 235 (associated with the main transmitter 205), as well as capture areas 240-255 (each associated respectively with booster transmitters 210-225). As a result the listening area 200 tracks the highway 230 illustrated in FIG. 2.

One problem, however, with the use of multiple transmitters transmitting on a single frequency is the risk of interference between the broadcast signals emanating from neighboring transmitters. This is a particular problem in geographic areas where the capture areas for neighboring transmitters overlap (e.g., overlap areas 260 illustrated in FIG. 2; also known as "interference bands").

The overlap areas can be critical areas where the interference between the RF signals emanating from neighboring transmitters needs to be controlled. This is because main and booster transmitters operating on the same broadcast channel in these overlap areas may heterodyne with each other and create unwanted tones in listeners' receivers or even result in unintelligible audio.

Thus, using conventionally-known booster transmitters to boost signal strength in a broadcast area can require technology for synchronizing or the signals transmitted by the booster and main transmitters. This synchronization, which is also sometimes referred to as simulcasting (an example of which being marketed under the tradename Synchrocast®) enables the coordinated delivery of broadcast signals from a plurality of transmitters including at least one main transmitter and at least one booster transmitter. It should be appreciated that booster transmitters can be used along with at least one main transmitter for the transmission of either analog or digital signals.

Main/booster transmitter simulcasting is the simultaneous broadcast of audio (analog audio, digital audio or data) by a number of transmitters on a single radio frequency. Thus, main/booster transmitter simulcasting is the use of multiple, overlapping transmitters, operating on the same frequency, in a particular radio broadcasting market. Main/booster transmitter simulcasting can provide dramatically increased signal strength and/or implement a licensed broadcast area with unusual dimensions. Conventionally known techniques and technology including simulcasting technology can be used to minimize, mitigate or eliminate the undesirable effects of booster stations while providing the advantage of transmitting on a single frequency. Techniques and technology for this synchronization are discussed in more detail herein in the context of various disclosed embodiments.

Radio broadcasters conventionally use main/booster transmitter simulcasting to surround a radio broadcast area (e.g., in a metropolitan area) with low-powered booster transmitters to cover the entire listening area. Thus, in a conventionally-known broadcasting area wherein main and booster transmitters are used, the radio broadcasting or listening area may be divided into a plurality N of separate and distinct transmitter areas through the use of N−1 synchronized booster transmitters and a reduced power main transmitter; however, division of the broadcasting listening area may actually be functionally implemented only during the duration of a non-programming broadcast period, e.g., during a commercial break, public service announcement, etc.

With this general understanding of main and booster transmitters operation and associated issues in mind, a description of various embodiments is now provided.

In accordance with at least one disclosed embodiment, radio broadcasting equipment is provided that enables targeted radio broadcast advertisement delivery in an radio broadcast area wherein a plurality of radio transmitters are used to transmit broadcasting area wide programming and localized auxiliary information on a single frequency and wherein broadcasting area wide programming is transmitted by at least one of the radio transmitters and localized auxiliary information is transmitted by individual radio transmitters included in the plurality of transmitters.

Incorporation of the radio broadcasting equipment provided in accordance with disclosed embodiments enables medium and large-market radio broadcasters to increase advertising revenue, compete with suburban located radio broadcaster competition for advertising and access conventionally unavailable advertisers in a radio broadcasting market.

A radio commercial (also colloquially referred to as a "spot" by personnel in radio broadcasting) is a form of advertising via radio. In accordance with at least one disclosed embodiment, commercial spots that are sold may be sold to one or more local trade areas associated with one or more transmitters used in a radio broadcast area at a reduced spot rate but a rate greater than the full rate divided by N. Thus, disclosed embodiments have particular utility in that they enable the segmenting of a radio broadcast market area to provide localized advertising to various sub-market areas to effectively provide the opportunity to increase advertising revenue in a radio broadcasting listening area.

As an added point of functionality, the radio broadcasting equipment is able to enable broadcast of other types of localized auxiliary information including, for example, localized emergency broadcast announcements and public service announcements. Thus, by utilizing the radio broadcasting equipment provided in accordance with disclosed embodiments, a radio broadcaster can broadcast an emergency alert only to a localized area affected by the alert rather than to an entire listening audience. Thus, use of the disclosed embodiments may further improve a listening audience's attention to such emergency alerts because the audience will learn to understand that a broadcast emergency alert is specific to a localized listening area.

Thus, it should be understood that illustrated embodiments may be implemented in a conventionally known radio broadcasting environment in which booster transmitters may have been conventionally utilized to boost radio broadcast transmission signals transmitted by a main transmitter utilized by a radio broadcaster to compensate for physical, man-made or geographic obstacles within the radio broadcaster's listening area. One example of such a broadcasting environment is illustrated in FIG. 1. In such a conventionally known implementation, the booster transmitters transmit on the same frequency as the main transmitter.

In accordance with the illustrated embodiments, at least one main transmitter and a plurality of booster transmitters are utilized in a prescribed manner to segment a listening area into a plurality of sub-market areas for which localized auxiliary information may be broadcast to better serve and reach listeners within each sub-market area.

In accordance with at least a first disclosed embodiment, a radio broadcaster utilizes at least one main transmitter to transmit broadcasting area wide programming and utilizes a plurality of booster transmitters to transmit localized auxiliary information.

The main transmitter is configured to transmit broadcasting area wide programming; however, the plurality of booster transmitters may be each configured to transmit different localized auxiliary information then some or all of each other. Thus, this differing localized auxiliary information may be specific to each of the booster transmitters; alternatively some sub-set of the booster transmitters may transmit the same localized auxiliary information as each other; further, some sub-set of the booster transmitters may transmit the same localized auxiliary information as the main transmitter.

In such an implementation, the main transmitter may be turned off synonymously (or nearly synonymously with the plurality of booster transmitters being turned on; however, if the main transmitter is shielded from the booster transmitters by geographic terrain or man-made terrain, e.g., buildings, there may be no need to turn off or reduce power for the main transmitter.

The booster transmitters are triggered to be turned on in response to an inaudible tone being incorporated in the signal broadcast by the main transmitter. That inaudible tone may, for example, signal the instruction of the booster transmitters to begin transmission of localized auxiliary information in a specified period of time (e.g., 90 seconds from completion of the tone). As a result of such a configuration, the switching time between ending transmission by the main transmitter and beginning transmission by the booster transmitters may be, for example, less than half a second.

Subsequently, the localized auxiliary information may be formatted in one or more preselected blocks, e.g., 5, 10, 15, 30, 45 or 60 seconds. Thus, receipt of the inaudible tone may instruct a booster transmitter to broadcast one or more preselected blocks of localized auxiliary information, for example, three blocks of localized auxiliary information being associated with three advertising commercials stored in a queue of advertising commercials to be broadcast. As an alternative or in one implementation, the inaudible tone may include an indication of the type of localized auxiliary information to be broadcast, e.g., one or more localized advertisements, a localized traffic report, a localized public service announcement, a localized emergency broadcast announcement, etc. Moreover, the inaudible tone may also or alternatively include an indication of the length of booster transmitter broadcast instructed.

As mentioned above, in accordance with one potential implementation, broadcast by the booster may be triggered to be turned on in response to an inaudible tone being incorporated in the signal broadcast by the main transmitter; alternatively, transmission by the booster may be triggered thru a separate TCP/IP connection. For example, this could be performed using one or more GPIO (General Purpose Input Output) devices that use relay contact closures or TTL voltage levels for triggering changes in state and operation.

Thus, a change in the state of the Relay or TTL trigger may be transmitted to the booster (e.g., using TCP/IP tunneling or some other mechanism or technology) to indicate powering up or down the booster.

Therefore, in accordance with at least one embodiment of the invention, the system may be implemented in part by overlaying a wireless communication network over a single cast system (e.g., such as one manufactured by Harris RF Communications in Rochester, N.Y.) and configured to enable the broadcast system to switch over to a different audio source (that audio source being provided via, for example, IP tunneling). It should also be appreciated that, in accordance with at least one embodiment of the invention, that this aspect of the system may include one or more analog to digital conversion stages interspersed within the system with IP tunneling; alternatively the system may be implemented entirely using IP tunneling technology. It should be understood that the selection of these alternative configurations may be based on economics and a cost of implementing the system.

RS-232 ASCII type control data transmitted over the radio link could also be used, as could detection of audio from an auxiliary audio source (e.g., which could cause a trigger to be activated).

It should be appreciated that there are various alternative mechanisms of implementing the disclosed embodiments of the invention. Therefore, if a broadcaster has a newer IP-based STL link network, the implementation would be different than for an older type of network. Therefore, in technology for older radio networks, it may be preferred to overlay a separate audio and control path to a booster using, for example, a wireless network (e.g., microwave, 3G, 4G, WiMAX, etc), satellite, or wireline (e.g., T1 or DSL, etc.)

In accordance with at least a second disclosed embodiment, a radio broadcaster utilizes both at least one main transmitter and a plurality of booster transmitters to transmit broadcasting area wide programming. The plurality of booster transmitters also transmit localized auxiliary information; however, the main transmitter does not transmit localized auxiliary information. As a result, in accordance with at least the second disclosed embodiment, there may be no need to transmit an inaudible tone to the booster transmitters to trigger their operation because the booster transmitters are transmitting both broadcasting area wide programming and localized auxiliary information; as a result, the booster transmitters may be continuously transmitting.

In accordance with at least a third disclosed embodiment, a radio broadcasting station utilizes at least one main transmitter and a plurality of booster transmitters. The main transmitter is configured to transmit broadcasting area wide programming and localized auxiliary information; however, the plurality of booster transmitters may be each configured to transmit different localized auxiliary information then the main transmitter. This differing localized auxiliary information may be specific to each of the booster transmitters; alternatively some sub-set of the booster transmitters may transmit the same localized auxiliary information as each other; further, some sub-set of the booster transmitters may transmit the same localized auxiliary information as the main transmitter.

The booster transmitters may be configured to transmit the same broadcasting area wide programming as the main transmitter; however, both the main transmitter and each of the plurality of booster transmitters may transmit different localized auxiliary information that is directed to the geographic location associated with the capture area for the transmitters.

In at least this embodiment, the main transmitter's broadcast signal strength can be reduced to temporarily convert that main transmitter to another booster transmitter when transmitting during broadcast periods of localized auxiliary information. As explained herein, this alteration in the signal strength of the main transmitter can effectively enable transmission of localized auxiliary information by each of the booster transmitters without terminating transmission of a broadcast signal by the main transmitter. Additionally, or optionally, the radio broadcasting equipment located at the main transmitter can instruct the plurality of booster transmitters to increase their signal strength without altering the main transmitter's signal strength. Alternatively, the radio broadcasting equipment for the main transmitter could simply trigger the booster transmitters to increase their signal strength without reducing the signal strength at the main transmitter.

Figure 5:
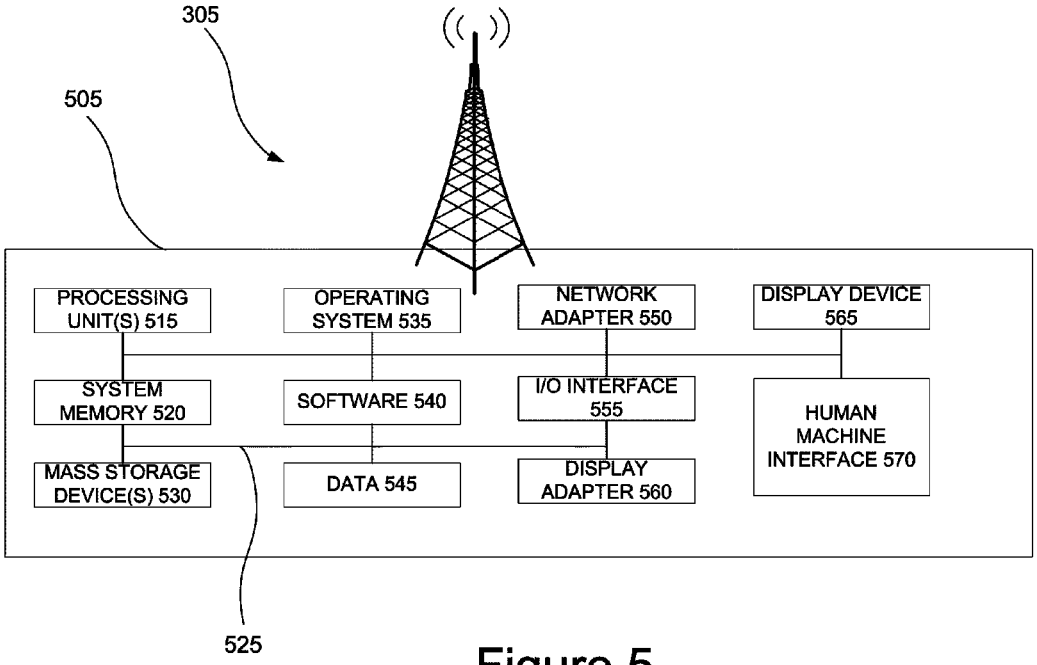
FIG. 5 illustrates the equipment that may be used to implement, in whole or in part, the operations performed for the main transmitter in connection with any one of the disclosed embodiments.
Figure 6:
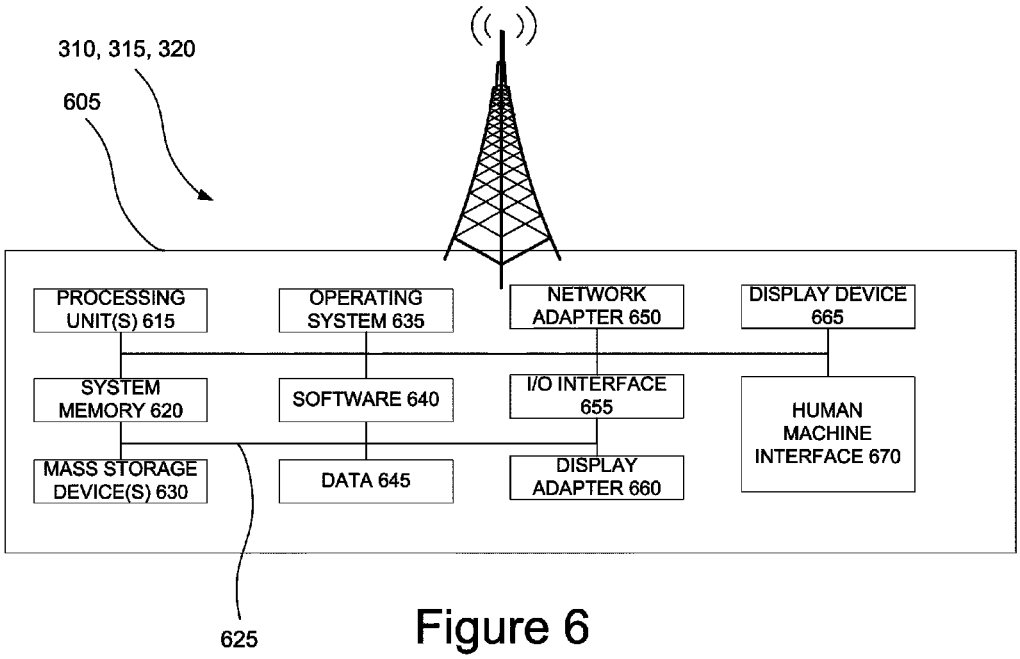
FIG. 6 illustrates the equipment that may be used to implement, in whole or in part, the operations performed for one of the booster transmitter in connection with any one of the disclosed embodiments.

The disclosed embodiments may each be implemented utilizing radio broadcasting equipment that is located at the transmitters (e.g., main and booster transmitters) or alternatively, remote from the transmitters but coupled thereto for the purposes of control and communication. FIGS. 5 and 6 illustrate such radio broadcasting equipment. FIG. 5 illustrates the equipment that may be used to implement in whole or in part the operations performed for the main transmitter in connection with any one of the disclosed embodiments. FIG. 6 illustrates the equipment that may be used to implement in whole or in part the operations performed for one of the booster transmitter in connection with any one of the disclosed embodiments.

It should be understood that the disclosed operations and equipment can be implemented by or operational with one or more general purpose or special purpose computing system environments or configurations. Examples of well known computing systems, environments, and/or configurations that can be suitable for use with the disclosed operations and equipment comprise, but are not limited to, personal computers, server computers, laptop devices, routing and/or switching devices and multiprocessor systems. Additional examples comprise set top boxes, programmable consumer electronics, network Personal Computers (PCs), minicomputers, mainframe computers, distributed computing environments that comprise any of the above systems or devices, and the like. The processing of the disclosed operations and equipment can be performed by software components, hardware components, firmware or any other known variation. The disclosed operations and equipment can be implemented in the general context of computer-executable instructions, such as program modules, being executed by one or more computers or other devices. Generally, program modules comprise computer code, routines, programs, objects, components, data structures, etc. that perform particular tasks or implement particular abstract data types. The disclosed operations and equipment can also be implemented in grid-based and distributed computing environments where tasks are performed by remote processing devices that are linked through a communications network. In a distributed computing environment, program modules can be located in both local and remote computer storage media including memory storage devices.

Figure 3:
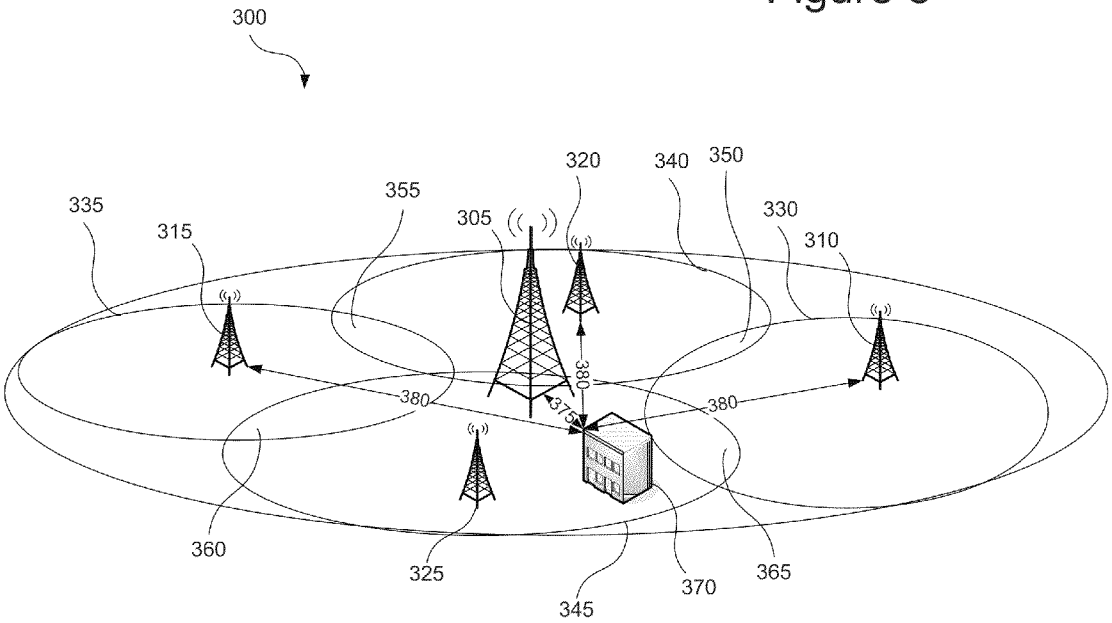
FIG. 3 illustrates a radio broadcast listening area environment in which one or more of the illustrated embodiments may be utilized to deliver broadcast area wide programming as well as localized auxiliary information via a plurality of antennas on a single frequency.

Further, one skilled in the art will appreciate that the operations and radio broadcasting equipment disclosed herein and resident at the transmitters can be implemented via a general-purpose computing device in the form of a computer (505 illustrated in FIG. 5 in conjunction with transmitter 305 also illustrated in FIG. 3 or 605 illustrated in FIG. 6 in conjunction with any one of transmitters 310-320 also illustrated in FIG. 3) coupled to the actual broadcasting equipment (e.g., one or more antennas and associated power and control equipment). The components of such a computer can comprise, but are not limited to, one or more processors or processing units (515, 615 illustrated in FIGS. 5-6 respectively), a system memory (520, 620 illustrated in FIGS. 5-6 respectively), and a system bus (525, 625 illustrated in FIGS. 5-6 respectively) that couples various system components including the processor to the system memory. In the case of multiple processing units, the radio broadcasting equipment can utilize parallel computing.

The system bus represents one or more of several possible types of bus structures, including a memory bus or memory controller, a peripheral bus, an accelerated graphics port, and a processor or local bus using any of a variety of bus architectures. By way of example, such architectures can comprise an Industry Standard Architecture (ISA) bus, a Micro Channel Architecture (MCA) bus, an Enhanced ISA (EISA) bus, a Video Electronics Standards Association (VESA) local bus, an Accelerated Graphics Port (AGP) bus, and a Peripheral Component Interconnects (PCI), a PCI-Express bus, a Personal Computer Memory Card Industry Association (PCMCIA), Universal Serial Bus (USB) and the like. The bus, and all buses specified in this description can also be implemented over a wired or wireless network connection and each of the subsystems, including the processor, a mass storage device (530, 630 illustrated in FIGS. 5-6 respectively), an operating system (535, 635 illustrated in FIGS. 5-6 respectively), software (540, 640 illustrated in FIGS. 5-6 respectively), data (545, 645 illustrated in FIGS. 5-6 respectively), a network adapter (550, 650 illustrated in FIGS. 5-6 respectively, and which may include communication network equipment and software to enable GPS, Internet communication, wireless communication etc.), the system memory, an Input/Output Interface (555, 655 illustrated in FIGS. 5-6 respectively), a display adapter (560, 660 illustrated in FIGS. 5-6 respectively), a display device (565, 665 illustrated in FIGS. 5-6 respectively), and a human machine interface (570, 670 illustrated in FIGS. 5-6 respectively), can be contained within one or more remote computing devices at physically separate locations, connected through buses of this form, in effect implementing a fully distributed system.

Figure 4:
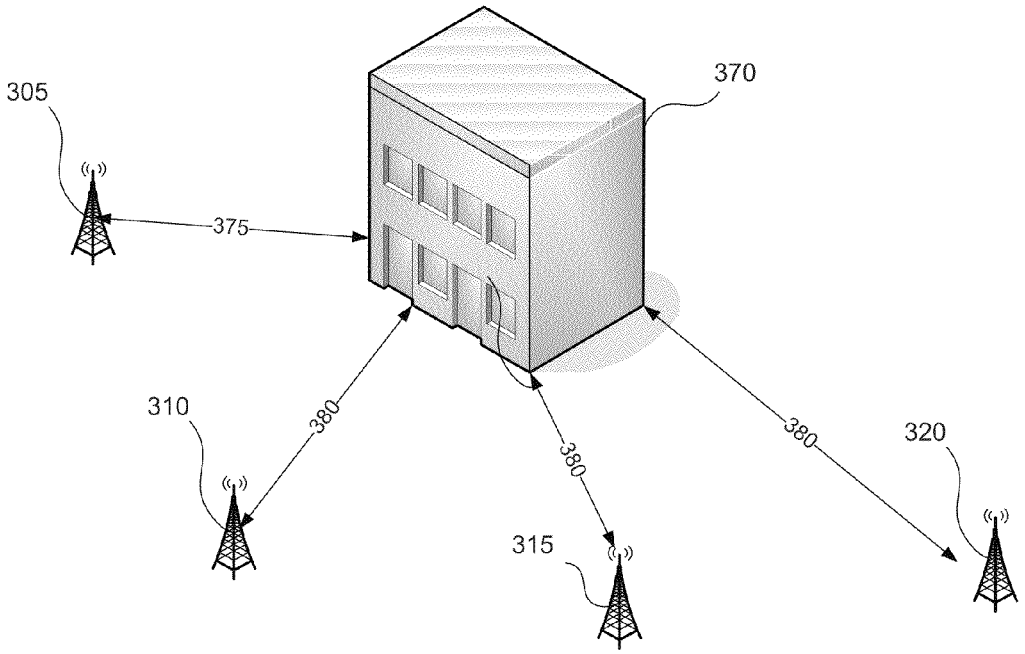
FIG. 4 is an illustrative example of the interconnectedness and communication between a studio and various transmitters utilized in accordance with at least one embodiment 305-320.

It should be understood that some or all of the components described may cooperate in a manner that enables the transmitter to communicate with, for example, a studio such as studio 370 illustrated in FIG. 3 to receive broadcast area wide programming and/or localized area programming for distribution via the transmitter. FIG. 4 further illustrates the communication between the studio 370 and the various transmitters 305-320.

It should be appreciated that the type of information transmitted between the studio 370 and the main transmitter 305 may be different and greater or less in size then the information transmitted between the studio 370 and the booster transmitters 305-320. This is particularly true when, for example, the booster transmitters are only transmitting auxiliary information but not broadcast area wide programming. Although not specifically illustrated, it should be appreciated that the components include hardware and software that enable the transmitter components to communicate with a studio or the main transmitter facilities via multiplexed digital STLs, across leased T1/E1 circuits, microwave radio links, Inter City Relay, telephone lines, dedicated cables, fiber optics, etc. It should be understood that, in implementation, it may be that an STL, either analog or digital, has a T1 capacity that is insufficient to support additional audio and control information; as a result, it should be appreciated that an STL carrying such information would be provided as an 'overlay' independent of the existing STL.

The computer (505 illustrated in FIG. 5 in conjunction with transmitter 305 also illustrated in FIG. 3 or 605 illustrated in FIG. 6 in conjunction with any one of transmitters 310-320 also illustrated in FIG. 3) typically comprises a variety of computer readable media. Exemplary readable media can be any available media that is accessible by the computer and comprises, for example and not meant to be limiting, both volatile and non-volatile media, removable and non-removable media. The system memory comprises computer readable media in the form of volatile memory, such as random access memory (RAM), and/or non-volatile memory, such as read only memory (ROM). The system memory typically contains data such as data and/or program modules such as the operating system and software that are immediately accessible to and/or are presently operated on by the processing unit.

In another aspect, the computer can also comprise other removable/non-removable, volatile/non-volatile computer storage media. By way of example, the mass storage device can provide non-volatile storage of computer code, computer readable instructions, data structures, program modules, and other data for the computer. For example and not meant to be limiting, a mass storage device can be a hard disk, a removable magnetic disk, a removable optical disk, magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like.

Optionally, any number of program modules can be stored on the mass storage device, including by way of example, the operating system and software. Each of the operating system and software (or some combination thereof) can comprise elements of the programming and the software. Data can also be stored on the mass storage device in any of one or more databases known in the art. Examples of such databases comprise, DB2®, Microsoft® Access, Microsoft® SQL Server, Oracle®, mySQL, PostgreSQL, and the like. The databases can be centralized or distributed across multiple systems.

It should be understood that a user can enter commands and information into the computer via an input device (not shown). Examples of such input devices comprise, but are not limited to, a keyboard, pointing device (e.g., a "mouse"), a microphone, a joystick, a scanner, tactile input devices such as gloves, and other body coverings, and the like These and other input devices can be connected to the processing unit(s) via the human machine interface that is coupled to the system bus, but can be connected by other interface and bus structures, such as a parallel port, game port, an IEEE 1394 Port (also known as a Firewire port), a serial port, or a universal serial bus (USB).

Additionally, it should be understood that the display device can also be connected to the system bus via an interface such as the display adapter. It is contemplated that the computer can have more than one display adapter and the computer can have more than one display device.

The computer can operate in a networked environment using logical connections to one or more remote computing devices. By way of example, a remote computing device can be a personal computer, portable computer, a server, a router, a network computer, a peer device or other common network node, and so on. Logical connections between the computer and a remote computing device can be made via a Local Area Network (LAN) and a general Wide Area Network (WAN). Such network connections can be through a network adapter that may be implemented in both wired and wireless environments. Such networking environments are conventional and commonplace in offices, enterprise-wide computer networks, intranets, and the Internet.

For purposes of illustration, application programs and other executable program components such as the operating system are illustrated herein as discrete blocks, although it is recognized that such programs and components reside at various times in different storage components of the computing device, and are executed by the data processor(s) of the computer. An implementation of software can be stored on or transmitted across some form of computer readable media. Any of the disclosed methods can be performed by computer readable instructions embodied on computer readable media. Computer readable media can be any available media that can be accessed by a computer. By way of example and not meant to be limiting, computer readable media can comprise "computer storage media" and "communications media." "Computer storage media" comprise volatile and non-volatile, removable and non-removable media implemented in any method or technology for storage of information such as computer readable instructions, data structures, program modules, or other data. Exemplary computer storage media comprises, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

Figure 7:
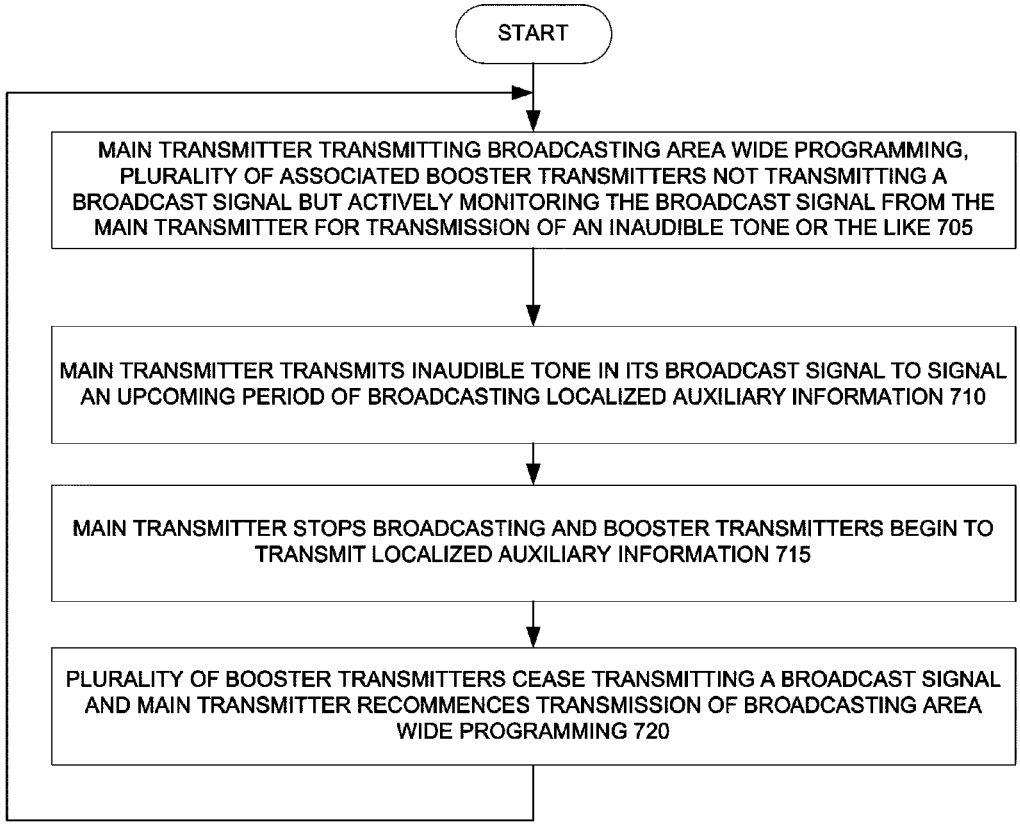
FIG. 7-9 illustrate the relative operation and cooperation of the main transmitter and the plurality of booster transmitters in accordance with at least the first, second and third illustrated embodiments.
Figure 8:
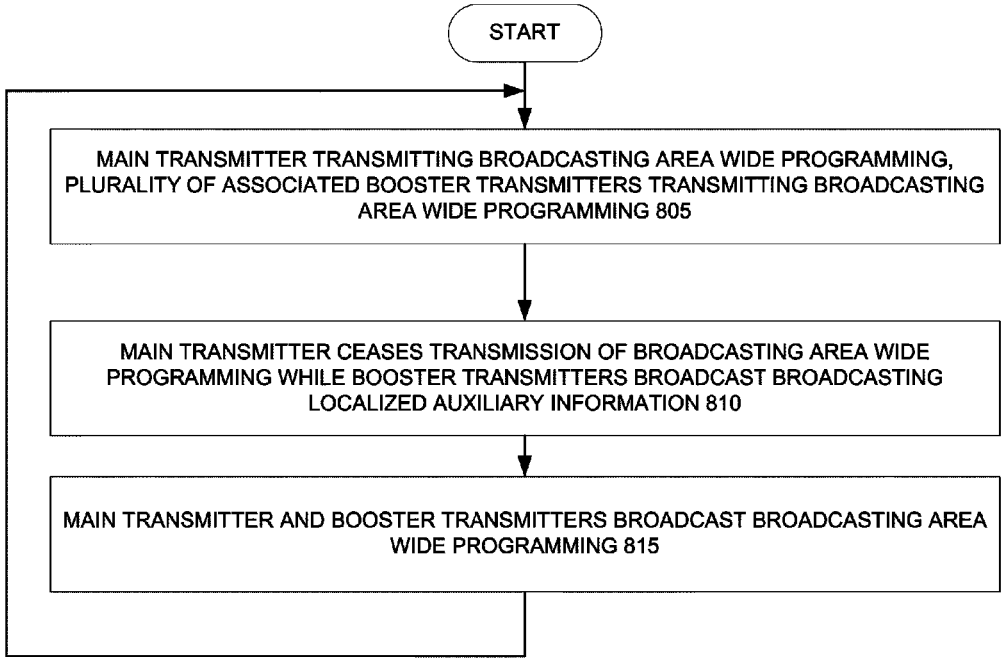
Figure 9:
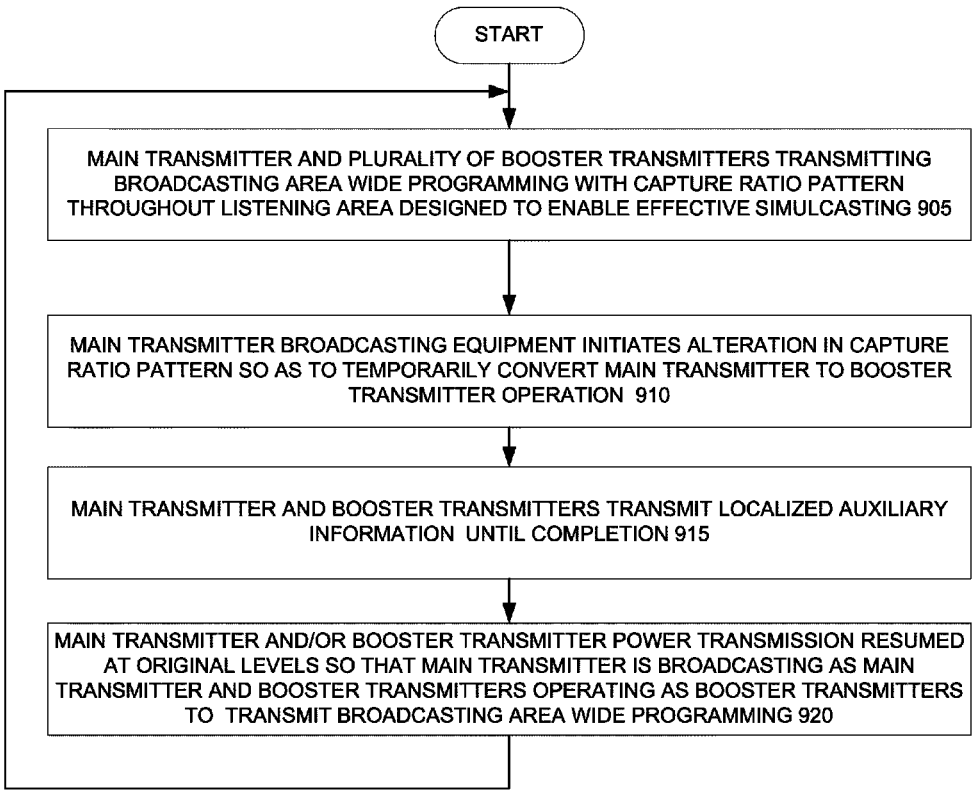

FIGS. 7-9 illustrate the relative operation and cooperation of the main transmitter and the plurality of booster transmitters in accordance with at least the first, second and third illustrated embodiments.

As shown in FIG. 7, in accordance with at least a first disclosed embodiment, operations include, at 705, at least one main transmitter transmitting broadcasting area wide programming while a plurality of associated booster transmitters are not transmitting a broadcast signal but are actively monitoring the broadcast signal from the main transmitter for transmission of an inaudible tone or the like. Control then proceeds to 710 at which the main transmitter transmits an inaudible tone in its broadcast signal to signal an upcoming period of broadcasting localized auxiliary information. Control then proceeds to 715, at which the main transmitter stops broadcasting and the booster transmitters begin to transmit localized auxiliary information.

The booster transmitters continue to transmit scheduled localized auxiliary information (as received from, for example, a studio or other facility or equipment) until its completion, at 720, at which time the plurality of booster transmitters cease transmitting a broadcast signal and the main transmitter recommences transmission of the broadcasting area wide programming. Subsequently, the main transmitter's broadcasting continues until a time at which additional localized auxiliary information is to be broadcast.

As shown in FIG. 8, in accordance with at least a second disclosed embodiment, operations include, at 805, at least one main transmitter and a plurality of booster transmitters are used to transmit broadcasting area wide programming. The plurality of booster transmitters also transmit localized auxiliary information; however, the main transmitter does not transmit localized auxiliary information. Control then proceeds to 810 at which the main transmitter ceases transmission of broadcasting area wide programming at the point in time beginning a period when only localized auxiliary information is to be broadcast. Thus, the plurality of booster transmitters continue to transmit a broadcast signal that includes localized auxiliary information but the main transmitter does not transmit any broadcast signal. The booster transmitters continue to transmit scheduled localized auxiliary information (as received from, for example, a studio or other facility or equipment) until its completion, at 815, at which time the plurality of booster transmitters switch to transmitting broadcasting area wide programming and the main transmitter recommences transmission of the broadcasting area wide programming. Subsequently, the main and booster transmitters' broadcasting continues until a time at which additional localized auxiliary information is to be broadcast again.

As shown in FIG. 9, in accordance with at least a third disclosed embodiment, operations include, at 905, at least one main transmitter and a plurality of booster transmitters each being configured to transmit both broadcasting area wide programming and localized auxiliary information. However, the plurality of booster transmitters may be each configured to transmit different localized auxiliary information then the main transmitter.

At 910, the capture-ratio pattern for the listening area (the concept of capture ratio being explained further below in conjunction with mechanisms for reducing inter-transmitter interference) is altered so as to essentially convert the main transmitter's broadcast signal to the same relative strength as that of each of the plurality of booster signals. Accordingly, at 915, the main transmitter serves as a booster transmitter and, along with the other booster transmitters, transmits localized auxiliary information pertaining to the capture area associated with its operation as a booster transmitter.

As explained above, this alteration can be performed in a number of different ways; for example, the main transmitter's broadcast signal strength while the plurality of booster transmitters maintain their signal strength. As explained herein, this alteration in the signal strength of the main transmitter can effectively enable transmission of localized auxiliary information by each of the booster transmitters without terminating transmission of a broadcast signal by the main transmitter. Additionally, or optionally, the radio broadcasting equipment located at the main transmitter can instruct the plurality of booster transmitters to increase their signal strength without altering the main transmitter's signal strength. Alternatively, the radio broadcasting equipment for the main transmitter could simply trigger the booster transmitters to increase their signal strength without reducing the signal strength at the main transmitter.

The altered capture ratios resulting from the signal strength adjustments performed at 910 are then maintained to transmit scheduled localized auxiliary information (as received from, for example, a studio or other facility or equipment) until its completion, at 920, at which time the transmitters return to their original signal strengths for transmission of the broadcasting area wide programming. Subsequently, the main and booster transmitters' broadcasting continues until a time at which additional localized auxiliary information is to be broadcast again.

As mentioned above, disclosed embodiments have particular utility in that they enable the segmenting of a radio broadcast market area to provide localized advertising to various sub-market areas to effectively provide the opportunity to increase advertising revenue in a radio broadcasting listening area. Thus, advertising time may be sold in each of the various sub-market areas on an individual (or collective) basis to increase advertisement revenue. As a result, a radio broadcaster can sell advertising to smaller businesses or those wanting to only target a certain geographic portion of the broadcaster's listening area.

Therefore, disclosed embodiments enable larger metropolitan area radio broadcasters to sell targeted advertising to smaller advertisers even though such advertisers have been and continue to be unwilling or unable to pay top-tier advertising rates to advertise on "downtown" stations. Thus, the disclosed embodiments provide utility in that the incorporated technology enables the "downtown" radio stations to sell advertising spots that are delivered only to a portion of their listening audience that is targeted to the advertiser.

Such advertising spots may be sold, for example, at an incremental advertising rate to target sub-metro marketing areas at a lower unit rate; thus, advertising time can literally be sold several times over in localized segments, gaining a greater piece of the available advertising revenue.

For example, a radio broadcaster may install booster transmitters in suburban areas of a metropolitan area; these suburban areas may define the local trade areas. Upon the start of a commercial break, the radio broadcasting equipment located at the main transmitter and at the booster transmitters may operate as described above in conjunction with aspects of the first, second and/or third disclosed embodiments to deliver advertising spots targeted to various sub-metro areas as well as broadcast area wide programming.

As an added point of functionality, the radio broadcasting equipment is able to enable broadcast of other types of localized auxiliary information including, for example, localized emergency broadcast announcements and public service announcements. Thus, by utilizing the radio broadcasting equipment provided in accordance with disclosed embodiments, a radio broadcaster can broadcast an emergency alert only to a localized area affected by the alert rather than to an entire listening audience. Thus, use of the disclosed embodiments may further improve a listening audience's attention to such emergency alerts because the audience will learn to understand that a broadcast emergency alert is specific to a localized listening area.

Moreover, depending on the population composition of a geographic area associated with a particular booster transmitter, disclosed embodiments may be utilized to broadcast auxiliary information in a particular language; such an implementation may be particularly valuable in transmitting, for example, an emergency broadcast signal message in a language such as Spanish when the localized listening area may significantly or predominantly speak that language.

Moreover, localized auxiliary information may include a regionalized or localized news report that is specific to the localized area associated with a particular booster transmitter (or group of booster transmitters). Similarly, the news report may be a news report that includes information about events occurring in another country or region when the localized area includes a large immigrant population from that particular country or region. Alternatively, or in addition, such a news report or other types of auxiliary information may be transmitted via one or more booster transmitters associated with a particular state (wherein a listening area includes portions of multiple states such as the Washington D.C. metropolitan listening area), county (wherein a listening area includes portions of multiple counties) or city (wherein a listening area includes, for example, a city as well as a large unincorporated suburban area) within a particular listening area.

Additionally, when a listening area includes a large government facility, e.g., a military base, or a governmental-designated territory (e.g., a Native American reservation or the like), localized auxiliary information including news reports, emergency and public service announcements and advertising specific to those geographic areas and the listeners within those areas.

Furthermore, it should be appreciated that concept of localized auxiliary information is meant to extend to all information that may not be deemed relevant to broadcast over the entire listening area for a particular broadcaster. Therefore, for example, localized auxiliary information may include regionalized or localized traffic reports specific to the geographic area associated with a particular booster transmitter (or group of transmitters).

Broadcasting from two nearby transmitters on the same frequency can lead to serious reception problems in the interference band created by the overlap areas. However, use of conventionally known simulcasting technology, e.g., the conventionally known SynchroCast™ technology, helps reduce interference problems using various technologies including precision digital delay management.

In non-overlap areas, receivers may receive a broadcast signal from only one transmitter, which is the preferable condition. However, when a receiver is located in an overlap area, i.e., an interference band, the receiver may receive a broadcast signal from two neighboring transmitters, thereby creating unwanted interference.

There are various mechanisms and techniques for reducing, eliminating, mitigating or compensating for such interference. It should be appreciated that one or more of these techniques may be used in conjunction with the implementation of the disclosed embodiments to reduce interference between the main and booster transmitters and among the booster transmitters themselves. As a result, the following explanation of various types of interference mitigation, elimination and compensation techniques is provided to enable one of ordinary skill in the art to further implement the disclosed embodiments.

In accordance with at least the third disclosed embodiment, proper antenna placement and control of the RF power levels of the main transmitter and booster transmitters can optimize the ratio of the signal levels.

Relative signal strength describes the relationship of two or more transmitted signals, based on the location of the receiver. Taking the case of two overlapping transmitters, for example, within the capture area of the transmitters, the signal level of one transmitter is invariably stronger than that of the other. Although the signal strength of a signal emanating from a transmitter is a product of numerous variables, the RF power level of the transmitter is a significant factor when determining signal strength.

Thus, in accordance with each of the disclosed embodiments, and particularly with regard to the third disclosed embodiment, one mechanism for reducing or minimizing interference may be to rely on the relative strengths of the broadcast signals emanating from each of the transmitters.

As is understood in the art of radio broadcasting, when a radio listener's receiver (e.g., an FM receiver) is presented with multiple carrier signal (e.g., radio broadcasting signals) that have nearly identical frequencies, e.g., main and booster signals, amplitude limiting circuitry may be configured to "capture" only the stronger signal. Such amplitude limiting circuitry is conventionally included in commercially available radio receivers.

However, for such amplitude limiting circuitry to be effective at capturing only a stronger or strongest signal, the strongest signal strength may need to differ from the other weaker signal strengths by a specified amount, e.g., 15 dB or more. This is what is known as the "capture ratio." If the main and booster signals do not differ by this specified amount, distortion and interference artifacts can be heard in the transmitted audio. However, it should be understood that FM tuners, in a static environment, can have a capture ratio as low as 2.2 dB. Nevertheless, in a mobile environment, fading (e.g., both multi-path and lognormal fading) can cause deep nulls on the order of 20 dB over a single wavelength (e.g., 9 feet@100 MHz). Therefore, the capture ratio could range from as low as 3 dB (or less) to as high as 20 dB (or more).

Thus, it should be understood that, at least for the third disclosed embodiment, if reliance on the capture ratio is used to improve receivers' receipt of broadcast, then the booster transmitters may be transmitting at a signal strength that is significantly greater, e.g., 15 dB or more, then the main transmitter during the transmission of auxiliary information. This is because in at least the third disclosed embodiment, the main transmitter is transmitting all the time but the booster transmitters are only transmitting during periods wherein localized auxiliary information is transmitted.

The relative signal strength difference between the main transmitter and the booster transmitters can be implemented in a number of different ways. For example, the main radio broadcasting equipment located at the main transmitter may signal the booster transmitters to increase their signal strength at a specified point in time by the transmission of an inaudible tone being incorporated in the signal broadcast by the main transmitter. Additionally, or optionally, the radio broadcasting equipment located at the main transmitter could also reduce the signal strength of the signal emanating from the main transmitter to provide the requisite relative strength difference to enable the amplitude limiting circuitry in radio receivers to capture the appropriate signal. Alternatively, the radio broadcasting equipment for the main transmitter could simply control reduction of the signal strength for the broadcast signal emanating from the main transmitter without instructing or controlling the booster transmitters to increase their signal strength.

It should be further understood that, although the use and manipulation of the capture ratio concept to reduce interference between transmitters is particularly useful in at least the third embodiment, other embodiments can utilize the concept to reduce interference between neighboring booster transmitters. In such implementations, careful selection of the broadcast signal strengths for various booster transmitters enables reducing or minimizing interference bands between neighboring booster transmitters. More specifically, signal strengths for neighboring booster transmitters may be set in a staggered or elevated order so that, between neighboring transmitter broadcast areas, one neighboring transmitter has a signal strength that is significantly greater than its neighbor (s).

It should also be appreciated that interference bands may be minimized or specifically located to minimize effect by using directional antennas to concentrate signals in desired areas while protecting them from exceeding strength limitations in other directions. A frequency search of the fundamental, as well as the first and second adjacent frequencies, can identify expansion possibilities as well as areas that require additional signal strength to provide adequate signal strength reception.

More specifically, to determine whether an antenna configuration associated with a particular transmitter is configured appropriately, one must consider the relative signal strength and total transmission delay experienced by a receiver in the capture area for that transmitter. For example, two neighboring transmitters may have equal transmission power but the total transmission delay between the studio and each transmitter may be different, based on audio processing time and path delay. Thus, when a receiver is located in the capture area associated with one of the transmitters (e.g., capture area 335 for transmitter 315 illustrated in FIG. 3), the amplitude limiting circuitry for the receiver should cause the receiver to lock in the broadcast transmission emanating from that transmitter; this is because the signal from that transmitter should be much stronger in the associated capture area (e.g., capture area 335) then the broadcast signal from a neighboring transmitter (e.g., transmitter 320 illustrated in FIG. 3). In such a situation, the signal from the neighboring transmitter can be considered an interfering signal. When the receiver is located in the capture area 340 illustrated in FIG. 3 and pertaining to transmitter 320, the reverse occurs.

When the receiver is located in the overlap area 355 illustrated in FIG. 3, however, the receiver may receive broadcast signals of almost equal strength from both transmitter sites. These signals interfere with each other.

Conventionally known simulcasting mechanisms and techniques solve the problems associated with this interference by adjusting for differences and variability in the STL path delay, and by providing a GPS-locked frequency reference to the transmitters to minimize or eliminate carrier frequency drift. For a booster-implemented radio broadcasting system to effectively use simulcasting, identical broadcast signals from potentially interfering transmitters (whether they be two booster transmitters or a main transmitter and one or more booster transmitters) must arrive at receivers at precisely controlled times. Modeling this is a theoretical impossibility for all potential radio broadcast receiver locations in a given listening area. However, it should be noted that drive test measurements and feedback/tuning of any propagation model, could develop a model, on a 1×1 meter square block of terrain, that has an accuracy within 1 dB mean signal level with a standard deviation of less than 3 dB. This is much higher accuracy than is the standard in the broadcasting arena. However, such a technique may require a very high resolution terrain and clutter (vegetation, buildings, etc) database to do so.

Additionally, approximations and minimum achievable levels can be effectively realized based on various techniques including the use of conventionally known frequency synchronization and modulation synchronization techniques and the introduction of time delay and phase propagation delay.

To avoid or minimize overlap, various factors are taken into consideration including booster location, natural or man-made terrain shielding, booster Effective Radiated Power (ERP) and antenna pattern. Thus, increasing or decreasing the power level of one transmitter relative to another can be used to shift a problematic interference band away from, or toward, that transmitter. Adjustments of one or both antenna patterns for interfering, neighboring transmitters can achieve the same result. Accordingly, an interference band can be effectively geographically shifted to a region where listeners are unlikely (e.g., a steep mountain slope) by manipulating various transmitter broadcasting equipment parameters.

Thus, proper location of transmitter sites is an important first step in implementing a main/booster transmitter implemented system. Once the transmitter sites have been determined, the next step is to design a signal distribution network that enables the carrier frequencies for the various transmitters to be locked together and the modulation to be aligned in both amplitude and phase. This may involve locking together the operation of radio broadcasting equipment located at both the main and booster transmitters so that all transmitters are locked to a Global Positioning System (GPS) timing standard conventionally used to reduce or eliminate unwanted artifacts at a listener's receiver.

Global Positioning Satellite (GPS) technology is conventionally recognized as an effective method for synchronizing transmitters. Specifically, a GPS receiver can deliver a precise timing reference to a studio (e.g., studio 370 illustrated in FIG. 3) and to each transmitter site (e.g., 305-320 illustrated in FIG. 3) in a simulcast system. At the studio, a timing signal may be transmitted along with broadcasting area wide programming and/or localized auxiliary information over the STL or the like to each transmitter site. Thus, localized auxiliary information may be transmitted from a centralized control point to each transmitter site prior to the date or time of its intended distribution via each transmitter sited and distribution may be triggered by the timing signal.

Alternatively, it should be understood that localized auxiliary information may be transmitted to each transmitter site in a manner that enables real-time distribution of the information via each transmitter site.

At the transmitters, the timing reference received from the studio may be compared to local timing signals to determine actual path delay. Once this delay is established, digital delay modules (implemented, for example, using software running on the processing units in the computer(s) for the terminals, as illustrated in FIGS. 5 and 6) incorporated in the radio broadcasting equipment located at each of the transmitters can calculate and introduce a precisely controllable delay, causing exact alignment of transmitted audio signals.

In addition, GPS receivers (also implemented, for example, using the components illustrated in FIGS. 5 and 6) at all transmitter sites can provide the same frequency reference signal to each transmitter, locking all of their carrier frequencies to the same satellite-delivered timing reference.

By phase locking the carrier of each transmitter to a single reference time base, a stable pilot signal can be produced; such a technique is both reliable and cost effective and can reduce the need for additional frequency spectrum to transmit a reference signal.

However, modulation levels for the main transmitter and one or more booster transmitters may also need to be controlled even if phase-locked carrier signals are used. The interference resulting from this type of modulation synchronization can manifest as interference artifacts sounding very similar to multipath interference; however, the interference artifacts are the result of nonsymmetrical sidebands in the RF carrier spectrum of a plurality of broadcast signals. Nevertheless, modulation synchronization interference can be addressed in whole or in part by using a single modulating source at a studio (for example, 370 as illustrated in FIG. 3) and replicating that modulation (or a determined deviation based on other factors) at each transmitter (e.g., 305-320 illustrated in FIG. 3).

Such conventionally known simulcasting techniques require complex equipment design, additional Radio Frequency (RF) engineering, increased maintenance as well as slight degradation in audio quality in coverage overlap areas. In addition, simulcasting requires more costly hardware than a conventional radio system utilizing a single transmitter; additionally, in some situations there is an increased risk of having audio blanked out in small areas by destructive interference such as multipath (a typical RF problem). Nevertheless, in accordance with at least one embodiment of the invention, boosters are broadcasting some portion of different content from each other. In situations where the content is always different (e.g., the boosters are not being used as conventional boosters to further boost the signals transmitted from the main transmitter, typical synchronization on the order of μseconds may not be necessary. Rather, it may be sufficient to provide synchronization on the order of tens of milliseconds; in such situations, the use of GPS and expensive Synchrocast-type equipment may also not be required.

It should be appreciated that the rights to sell and transmit broadcast signals including advertising using one or more of the booster transmitters may packaged in such a way that a plurality of trading areas (associated with one or more of the booster transmitters) may be established. The rights to sell and transmit advertising in these Local Trading Areas (LTAs) may be sold, licensed or otherwise transferred permanently or temporarily to one or more parties by the broadcaster with the broadcasting license for the broadcasting area including those LTAs. Moreover, it should be appreciated that a plurality of broadcasters may be able to use a plurality of booster transmitters to in each of their areas cooperatively so as to transmit the same package of advertising content to an LTA that encompasses the booster transmission areas for boosters in each of their broadcast areas.

For example, it is foreseeable that a small community or an extended community located between two larger radio metropolitan area markets may receive broadcast signals from stations primarily serving those metropolitan areas. However, advertising associated with those markets may not be appropriate or effective for distribution to the small or extended communities located in-between those markets. For example, those communities between the New York city metropolitan area and the Washington D.C. metropolitan area may receive radio broadcasts from radio stations located in those cities; however, because of the distance between New York and Washington D.C. and those communities, advertisers local to those metropolitan areas gain little or no benefit from having their advertising content distributed to those in-between communities; moreover, those radio stations gain no advertising benefit from local advertisers that might want to advertise over the radio but are unwilling or unable to pay for advertising time on those larger metropolitan-based radio stations.

However, stations in those metropolitan areas could cooperate to set up an LTA that may transmit differing broadcasting area wide content on different frequencies but transmit the same advertising content on those differing frequencies using booster transmitters utilized within each of their licensed broadcast areas. In this way, although the broadcasters would not be using their booster transmitters to extend their licensed area, they could cooperate with one another to provide a potentially valuable package of advertising services to an underserved radio broadcasting market sub-section.

Turning now to the concept and issues surround operation of radio broadcasting stations, it should be appreciated that operating costs of smaller transmitting facilities are a fraction of those associated with a single major market station transmitter. Thus, radio broadcast station acquisition costs may be far less; nevertheless, the resale value of radio broadcasting station that has been converted to a hybrid main/booster transmitter implementation may be many times the price of its individual component transmitters as a result of the cost differential for converted operation and the return differential for advertising revenue for the converted system.

It should be appreciated that major metropolitan stations typically utilize a powerful transmitter, driving an antenna located on a tall in-town building or in an antenna farm. Operating high-powered transmitters and leasing tower space both represent significant expenditures for such radio broadcasters. To the contrary, a hybrid main/booster simulcast systems may enable not only reducing the size and power of a main transmitter as well as moving that main transmitter location as a result of also using a plurality of booster transmitters.

Moreover, it should be appreciated that, in accordance with at least one embodiment, the disclosed technological innovation may enable two or more lower-power radio broadcasting stations to operate in a joint or cooperative manner using multiple main transmitters as well as a plurality of booster transmitters. Such an implementation may enable lower operating costs while achieving comparable coverage of a similarly sized radio broadcast listening area being served by a single high power transmitter. As a result, it should be appreciated that this technology has the potential to significantly increase the purchase price of a suburban radio station broadcasting area that may be either converted into a hybrid main/booster transmitter implementation or included with other such radio broadcasting areas.

Thus, implementing aspects of the disclosed embodiments enables the opportunity to leverage smaller radio broadcasting facilities and enhance their competitive position significantly. Capital outlay for such individual facilities is relatively low and the future resale value of the hybrid, simulcast system can be many times the price of the individual stations that make it up. Moreover, ownership of all the radio broadcasting stations on the same frequency also creates the opportunity for power increases at one or all transmitters or use of directional antennas to further improve coverage; since any potential for interference would be between co-owned stations, waivers can be simple to obtain.

While this invention has been described in conjunction with the specific embodiments outlined above, it is evident that many alternatives, modifications and variations will be apparent to those skilled in the art. Accordingly, the various embodiments of the invention, as set forth above, are intended to be illustrative, not limiting. Various changes may be made without departing from the spirit and scope of the invention.

For example, it should be understood that various disclosed embodiments relate to the broadcasting of analog radio broadcasting signals. However, it should be understood that the embodiments are not limited to analog radio broadcasting and may by utilized in digital audio radio broadcasting, for example, Eureka 147 (also known as Digital Audio Broadcasting (DAB)), 'DAB+, FM band in-band on-channel (FM IBOC) broadcasting including HD Radio (OFDM modulation over FM and AM band IBOC sidebands) and FMeXtra (FM band IBOC subcarriers), Digital Radio Mondiale (DRM) and its extension (DRM+) (OFDM modulation over AM band IBOC sidebands), AM band in-band on-channel (AM IBOC) including HD Radio (AM IBOC sideband) and DRM, Satellite radio including, e.g., WorldSpace, Sirius XM radio, and MobaHo!, Integrated Services Digital Broadcasting (ISDB), Low-bandwidth digital data broadcasting over existing FM radio and Radio Data System (also known as RDS), etc.

It should be appreciated that, in accordance with at least one embodiment of the invention, the system may be implemented in conjunction with the transmission of digital radio signals rather than analog radio signals. Moreover, it should be appreciated that at least one embodiment of the invention may be implemented in conjunction, and be compatible, with the DAB standard to enable implementation outside the United States radio markets.

Further, it should be appreciated that the various disclosed embodiments and their individual aspects and features also may be utilized in the transmission of analog and/or digital television signals.

Moreover, it should be understood that various connections are set forth between elements in the following description; however, these connections in general, and, unless otherwise specified, may be either direct or indirect, either permanent or transitory, and either dedicated or shared, and that this specification is not intended to be limiting in this respect.

Additionally, it should be understood that the functionality described in connection with various described components of various invention embodiments may be combined or separated from one another in such a way that the architecture of the invention is somewhat different than what is expressly disclosed herein. Moreover, it should be understood that, unless otherwise specified, there is no essential requirement that methodology operations be performed in the illustrated order; therefore, one of ordinary skill in the art would recognize that some operations may be performed in one or more alternative order and/or simultaneously.

Various components of the invention may be provided in alternative combinations operated by, under the control of or on the behalf of various different entities or individuals.

Further, it should be understood that, in accordance with at least one embodiment of the invention, system components may be implemented together or separately and there may be one or more of any or all of the disclosed system components. Further, system components may be either dedicated systems or such functionality may be implemented as virtual systems implemented on general purpose equipment via software implementations.

Unless otherwise expressly stated, it is in no way intended that any operations set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following inventive concepts.

Although the utility of various invention embodiments has been described in connection with the distribution of promotional content, it should be understood that distributed information is not limited to promotional content but may also or alternatively include non-promotional material.

Thus, for example, in accordance with at least one embodiment of the invention, an optional emergency services announcement component may be included. Such a component may be implemented, for example, to be responsive to a wirelessly communicated notification transmitted via a wireless transmitter under the control of emergency services personnel. Thus, in the event that an emergency announcement is required, fire, police or other emergency services department personnel may interrupt a regular broadcasting to trigger broadcasting in one or more (or all) subsets of a broadcasting area to provide emergency information regarding, a forest fire, a tornado warning, flash flood warnings, etc. Accordingly, the wirelessly communicated notification may include pre-recorded information to be transmitted on the one or more boosters and/or simply enable a trigger within the system to shift an audio source for a booster to a channel associated with emergency broadcast information.

Likewise, it should be appreciated that emergency services personnel could utilize this type of wireless communicated microcast notification for implementing an Amber Alert type announcement to disseminate information associated with child-abduction situations.

In accordance with at least one embodiment of the invention, the boosters may also be used as a transmission location point for communicating text messages or the like to a user's mobile phone or other Personal Data Assistant (PDA) based on the geographic location of the user. Accordingly, when a user travels into the booster area, the user's device may receive promotional information or offers regarding that an advertiser's business in that area. It should be appreciated that the transmission of such data from the boosters may be using a different communication protocol and technology and may not have any relationship to the timing of shifting from transmission of content from a main transmitter to one or more booster transmitters or vice versa.

In accordance with at least one embodiment of the invention, the booster transmitters, for example, may be configured to transmit a signal that may be received by circuitry installed at one or more billboards or other signage within a localized area associated with the booster. The transmission and receipt of the signal would trigger an LED readout on the board which would become visible simultaneously with the broadcasting of promotional material via the booster.

As a result, it will be apparent for those skilled in the art that the illustrative embodiments described are only examples and that various modifications can be made within the scope of the invention

We claim:

1. Radio broadcasting equipment that transmits broadcast signals in a radio broadcast area, the equipment comprising:

a plurality of broadcast transmitters including a main transmitter and a plurality of auxiliary transmitters that are each configured to simultaneously transmit content on a single frequency; and a mechanism for switching on transmission of localized auxiliary information content by each of the plurality of auxiliary transmitters and the main transmitter, wherein, at a first time, the main transmitter and the plurality of auxiliary transmitters all transmit the same broadcast area wide programming content as one another, wherein, at a second time, the main transmitter transmits localized auxiliary information content and the plurality of auxiliary transmitters each transmit localized auxiliary information content, wherein localized auxiliary information content transmitted by the main transmitter and transmitted by at least one of the plurality of auxiliary transmitters differs from localized auxiliary information content transmitted by other auxiliary transmitters, wherein the broadcast area wide programming content includes programming content for distribution throughout a particular broadcasting area and the localized auxiliary information content include at least one of advertisements, public safety information, public service information, emergency broadcast information, wherein, the main transmitter transmits localized auxiliary information content while the plurality of auxiliary transmitters transmit localized auxiliary information content on the single frequency, and wherein a capture-ratio pattern for the radio broadcast area is altered to convert the main transmitter's broadcast signal to a same relative strength as that of each broadcast signal of the plurality of auxiliary transmitters and the altered capture pattern is maintained during transmission of the localized auxiliary information until completion, at which time the capture-ratio pattern is returned to the capture ratio pattern for transmission of broadcast area wide programming.

2. The radio broadcasting equipment of claim 1, further comprising at least one Studio-Transmitter Link coupled to each of the plurality of transmitters and configured to carry both broadcast area wide programming and auxiliary information content transmitted from one or more studios to the plurality of transmitters.

3. The radio broadcasting equipment of claim 1, further comprising at least T1 line coupled to each of the plurality of transmitters and configured to carry both broadcast area wide programming and auxiliary information content transmitted from one or more studios to the plurality of transmitters.

4. The radio broadcasting equipment of claim 1, wherein the plurality of transmitters transmit analog radio signals.

5. The radio broadcasting equipment of claim 1, wherein the plurality of transmitters transmit digital radio signals.

6. The radio broadcasting equipment of claim 1, wherein each of the auxiliary transmitters is also configured to transmit localized auxiliary information content when the main transmitter has ceased transmission of broadcast area wide programming content.

7. The radio broadcasting equipment of claim 1, wherein each of the auxiliary transmitters is configured to both transmit broadcast area wide programming content in a simulcast manner when the main transmitter is transmitting broadcast area wide programming and also transmit localized auxiliary information content when the main transmitter has ceased transmission of broadcast area wide programming content.

8. The radio broadcasting equipment of claim 1, wherein the localized auxiliary information content includes audio data spoken in a language other than the language of the broadcast area wide programming content.

9. The radio broadcasting equipment of claim 1, wherein the mechanism includes components for incorporating an inaudible tone in the signal broadcast by the main transmitter, which triggers the auxiliary transmitters to begin transmission of localized auxiliary information in a specified period of time.

10. The radio broadcasting equipment of claim 1, wherein the mechanism includes at least one dedicated communication link provided between the main transmitter and each of the plurality of auxiliary transmitters and configured to carry control information indicating when transmission of localized auxiliary information by each of the plurality of auxiliary transmitters should begin.

11. The radio broadcasting equipment of claim 1, wherein the localized auxiliary information includes advertising content associated with advertisers located in the geographic area associated with the auxiliary transmitter transmitting the localized auxiliary information.

12. The radio broadcasting equipment of claim 1, wherein the localized auxiliary content includes information generated by emergency services personnel regarding a child abduction.

13. The radio broadcasting equipment of claim 1, wherein the localized auxiliary content includes information generated by emergency services personnel regarding a localized public emergency or event.

14. The radio broadcasting equipment of claim 1, wherein the localized public emergency includes one of a tornado, flash flooding or a forest fire and the localized public event includes one of road closures.

15. The radio broadcasting equipment of claim 1, wherein at least one of the auxiliary transmitters is further configured to transmit a trigger to circuitry included in signage within the geographic area associated with the auxiliary transmitter to trigger display of promotional content associated with the content being transmitted via the auxiliary transmitter.

16. The radio broadcasting equipment of claim 1, wherein at least one of the auxiliary transmitters is further configured to transmit data to one or more user devices located within a geographic area associated with content that has or will be transmitted via that auxiliary transmitter.

17. A method for simultaneously transmitting both broadcast area wide programming content and localized auxiliary information content within a single radio broadcast area, the method comprising:

operating a plurality of broadcast transmitters including a main transmitter and a plurality of auxiliary transmitters that are all configured to simultaneously transmit content on a single frequency; and switching on transmission of localized auxiliary information content by each of the plurality of auxiliary transmitters and the main transmitter, wherein, at a first time, the main transmitter and the plurality of auxiliary transmitters all transmit the same broadcast area wide programming content as one another, wherein, at a second time, the main transmitter transmits localized auxiliary information content and the plurality of auxiliary transmitters each transmit localized auxiliary information content on the single frequency, wherein localized auxiliary information content transmitted by the main transmitter and transmitted by at least one of the plurality of auxiliary transmitters differs from localized auxiliary information content transmitted by other auxiliary transmitters, wherein the broadcast area wide programming content includes programming content for distribution throughout a particular broadcasting area and the localized auxiliary information content include at least one of advertisements, public safety information, public service information, emergency broadcast information, and wherein a capture-ratio pattern for the radio broadcast area is altered to convert the main transmitter's broadcast signal to a same relative strength as that of each broadcast signal of the plurality of auxiliary transmitters and the altered capture pattern is maintained during transmission of the localized auxiliary information until completion, at which time the capture-ratio pattern is returned to the capture ratio pattern for transmission of broadcast area wide programming.

18. The method of claim 17, further comprising coupling each of the plurality of transmitters to one or more studios via at least one communication link and transmitting at least one of broadcast area wide programming and auxiliary information content from the one or more studios to at least one of the plurality of transmitters.

19. The method of claim 17, wherein each of the auxiliary transmitters is also configured to transmit localized auxiliary information content when the main transmitter has ceased transmission of broadcast area wide programming content.

20. The method of claim 17, wherein each of the auxiliary transmitters is configured to transmit broadcast area wide programming content in a simulcast manner when the main transmitter is transmitting broadcast area wide programming and also transmit localized auxiliary information content when the main transmitter has ceased transmission of broadcast area wide programming content.

21. The method of claim 17, further comprising transmitting different localized auxiliary content from at least two of the plurality of auxiliary transmitters.

22. The method of claim 21, wherein the differing localized auxiliary content includes advertisements for advertisers located in the geographic area associated with each of the at least two auxiliary transmitters.

23. The method of claim 17, wherein the localized auxiliary information content includes audio data spoken in a language other than the language of the broadcast area wide programming content.

24. The method of claim 17, wherein transmission by the auxiliary transmitters is triggered by an inaudible tone in the signal broadcast by the main transmitter, which triggers the auxiliary transmitters to begin transmission of localized auxiliary information in a specified period of time.

25. The method of claim 17, wherein transmission by the auxiliary transmitters is triggered via at least one dedicated communication link provided between the main transmitter and each of the plurality of auxiliary transmitters and configured to carry control information indicating when transmission of localized auxiliary information by each of the plurality of auxiliary transmitters should begin.

* * * * *